US011305246B2

(12) United States Patent
Nienhaus et al.

(10) Patent No.: US 11,305,246 B2
(45) Date of Patent: Apr. 19, 2022

(54) AGITATOR DEVICE

(71) Applicant: EKATO Ruehr- und Mischtechnik GmbH, Schopfheim (DE)

(72) Inventors: Bernd Nienhaus, Wehr (DE); Daniel Stangier, Grenzach-Whylen (DE); Thorsten Grebe, Basel (CH); Wolfgang Last, Neu-Ulm (DE); Nicole Rohn, Rheinfelden (DE)

(73) Assignee: EKATO Rühr- und Mischtechnik GmbH, Schopfheim (DE)

( * ) Notice: Subject to any disclaimer, the term of this patent is extended or adjusted under 35 U.S.C. 154(b) by 312 days.

(21) Appl. No.: 16/217,641

(22) Filed: Dec. 12, 2018

(65) Prior Publication Data

US 2019/0176107 A1 Jun. 13, 2019

(30) Foreign Application Priority Data

Dec. 13, 2017 (DE) ..... 10 2017 129 836.3

(51) Int. Cl.
*B22C 5/00* (2006.01)
*B01F 27/192* (2022.01)
(Continued)

(52) U.S. Cl.
CPC ..... *B01F 27/192* (2022.01); *B01F 27/0723* (2022.01); *B01F 27/0724* (2022.01);
(Continued)

(58) Field of Classification Search
CPC combination set(s) only.
See application file for complete search history.

(56) References Cited

U.S. PATENT DOCUMENTS 2,376,722 A * 5/1945 Podell ..... B01F 15/00694 366/282
2009/0212451 A1* 8/2009 Kim ..... C08G 63/133 264/6
2011/0261643 A1* 10/2011 Handa ..... B01F 7/00158 366/270

FOREIGN PATENT DOCUMENTS

CN 101757866 A 6/2010
CN 104787728 A 7/2015
(Continued)

OTHER PUBLICATIONS

Fujiwara, Shuzo, JP-2008012452-A, "Agitator", Jan. 2008 (Year: 2008).*

(Continued)

*Primary Examiner* — Anshu Bhatia
*Assistant Examiner* — Gregory Y Huan
(74) *Attorney, Agent, or Firm* — Posz Law Group, PLC

(57) ABSTRACT

An agitator device, in particular a non-close-clearance agitator device, in particular with respect to a vessel wall, in particular for mixing low-viscosity to medium-viscosity media, having at least one agitation shaft and having at least one outer agitation blade which is held on the agitation shaft and which in at least one section is implemented so as to be arm-shaped. The agitator device has an inner agitation blade which conjointly with the outer agitation blade implements at least one van-type conveying unit which is at least configured for conveying a medium in at least one direction parallel with the agitation shaft and in particular in at least one further direction perpendicular to the agitation shaft.

19 Claims, 4 Drawing Sheets

(51) Int. Cl.

| | |
|---|---|
| ***B01F 27/96*** | (2022.01) |
| ***B01F 27/113*** | (2022.01) |
| ***B01F 27/072*** | (2022.01) |
| ***B01F 27/1123*** | (2022.01) |
| ***B01F 27/1125*** | (2022.01) |

(52) U.S. Cl.
CPC ..... *B01F 27/0727* (2022.01); *B01F 27/113* (2022.01); *B01F 27/1123* (2022.01); *B01F 27/1125* (2022.01); *B01F 27/96* (2022.01)

(56) References Cited

FOREIGN PATENT DOCUMENTS

| | | | | | |
|---|---|---|---|---|---|
| DE | 20 2004 010 410 | U1 | | 11/2004 | |
| FR | 2893517 | A1 | * | 5/2007 | ..... B01F 15/00798 |
| JP | 2008012452 | A | * | 1/2008 | |

OTHER PUBLICATIONS

Machine translation for description of FR-2893517-A1 (Year: 2007).*
Office Action dated Jul. 26, 2018 issued in corresponding DE patent application No. 10 2017 129 836.3 (and English translation).
Partial english translation of Office Action dated Oct. 11, 2021 issued in corresponding CN patent application No.201811524892.X.

* cited by examiner

AGITATOR DEVICE

CROSS REFERENCE TO RELATED APPLICATION

This application is based on and incorporates herein by reference German Patent Application No. 10 2017 129 836.3 filed on Dec. 13, 2017.

PRIOR ART

The invention relates to an agitator device, in particular a non-close-clearance agitator device, in particular with respect to a vessel wall, according to the preamble of Claim 1.

Close-clearance agitator devices having grate-shaped and/or blade-shaped agitation blades which at least locally generate a radial flow are already known. An open geometry in an upper region additionally causes an axial flow which is created by a backflow of a medium in the direction of an agitator centre. Moreover, a multiplicity of predominantly close-clearance agitators similar to a helix and anchor which are in particular suitable for highly viscous media are known.

A close-clearance agitator which comprises agitator blades having a helical geometry and agitation blade's in the proximity of the bottom is furthermore known from the publication JP 5736127 B2.

The object of the invention is in particular to provide a generic device having improved agitation properties. The object is achieved according to the invention by the features of Claim 1 and of Claim 2, while advantageous design embodiments and refinements of the invention can be derived from the dependent claims.

Advantages of the Invention

The invention proceeds from an agitator device, in particular a non-close-clearance agitator device, in particular with respect to a vessel wall, in particular for mixing low-viscosity to medium-viscosity media, preferably for polymerization processes, having at least one agitation shaft and having at least one outer agitation blade which is held on the agitation shaft and which in at least one section is implemented so as to be arm-shaped.

In one aspect of the invention it is proposed that the agitator device has at least one inner agitation blade which conjointly with the outer agitation blade implements at least one vane-type conveying unit which is at least configured for conveying a medium in at least one direction parallel with the agitation shaft and in particular in at least one further direction perpendicular to the agitation shaft.

In one further aspect of the invention which can in particular be considered individually or else in combination with further aspects of the invention, it is proposed that the outer agitation blade has at least one further section which is adjacent to the section and in which the outer agitation blade is at least to a large part implemented so as to be wider than in the section.

On account thereof, improved agitation properties can be advantageously achieved. An improved mixing of a medium in at least one operational state of the agitator device can particularly advantageously be achieved. A shortened mixing time can advantageously be achieved. Moreover, a dependence of the mixing time on a viscosity can advantageously be reduced. An advantageous suspension in particular of solid proportions of the medium and/or in particular an improved emulsion and/or dispersion of the medium can in particular be enabled. Properties of the suspension, of the emulsion and/or of the dispersion can in particular be manipulated in a targeted manner. A flow of the medium in a direction parallel with and perpendicular to the agitation shaft can at least be achieved in a particularly advantageous manner. A proportion of the flow in a perpendicular direction can in particular be advantageously influenced. In particular, a flexible agitator device which can be operated as an axial and/or radial agitator device can be made available. Moreover, an improved thermal exchange between the medium and heating elements and/or cooling elements can advantageously be achieved.

An "agitator device" is in particular to be understood to be an, in particular functional, component part, in particular a constructive and/or functional component, of an agitator, in particular of a mixer and/or of an agitation system, in particular for low-viscosity to medium-viscosity media. The agitator device can in particular comprise the entire agitation apparatus. The agitator device is advantageously implemented as a component part of an agitator or as an agitator. The agitator device is particularly preferably configured for being rotated about a rotation axis, in particular when agitating and/or mixing. The agitator device, when viewed along an agitation shaft of the agitator device, is preferably implemented so as to be symmetrical with respect to a point, in particular in relation to a longitudinal extent of the agitation shaft. The agitation shaft in an assembled state advantageously runs parallel with a vertical direction, preferably in the direction of gravity acting thereon, in particular in a normal operational state of the agitation apparatus, wherein the vertical direction preferably runs perpendicularly to a hard surface.

That a constructive element is implemented so as to be "arm-shaped" herein is in particular to be understood in the sense that the constructive element is implemented so as to be elongate, wherein the constructive element has an in particular curved and/or angled longitudinal extent which is in particular larger by a factor of at least 2 than a transverse extent that is at least substantially perpendicular in relation to the longitudinal extent.

A "non-close-clearance agitator device" herein is in particular to be understood to be an agitator device in which a ratio between a largest diameter of the agitator device and an inner diameter of a container which is configured for use with the agitator device is larger than 1.05.

A "low-viscosity to medium-viscosity medium." herein is in particular to be understood to be a medium of which the dynamic viscosity lies below a reference value of 50 Pa s at a reference temperature of 20° C.

A "conveying unit" is in particular to be understood to be an in particular mechanical unit which in at least one operational state conveys, displaces and/or mixes a medium, in particular a fluid and/or a solid, in at least one direction. In particular, the conveying unit in at least one operational state can generate a flow in particular within a container. A "vane-type conveying unit" herein is in particular to be understood to be a conveying unit which has a surface which is composed of a plurality of in particular separate, closed part (-) regions which are mutually arranged at an angle and which partially delimit a volume. The surface herein can in particular have at least one opening and/or one gap.

The term "at least to a large part" herein is to be understood to mean in particular to at least 55%, advantageously to at least 65%, preferably to at least 75%, particularly preferably to at least 85%, and particularly advantageously to at least 95%. The outer agitation blade has in particular an average width which is preferably larger than 25%, particularly preferably larger than 40%, and smaller than 50% of a largest diameter of the agitator device, at least when viewed along the agitation shaft, wherein the average width is to be understood to be in particular a largest average expanse of the outer agitation blade perpendicular to the agitation axis in at least one operational position in which the agitator device in an operationally ready and assembled state can carry out at least one function. In particular, the further section in relation to at least one operational position is arranged in a lower region of the agitator device. The further section preferably has an average width which exceeds an average width of the section by a factor of at least 2.

It is furthermore proposed that the inner agitation blade conjointly with the further section of the outer agitation blade implements a shovel-type conveying unit. The inner agitation blade and the further section are in particular arranged so as to be mutually angled and conjointly form an engagement surface of the conveying unit for an input of energy into the medium. On account thereof, an optimized input of energy and an advantageous mixing of the medium can be performed. Moreover, a simple design of the vane-type conveying unit in terms of construction can be achieved on account thereof.

It is moreover proposed that the inner agitation blade is situated at least to a large part, in particular completely, in an inner agitation blade plane and is in particular implemented so as to be plate-type. The inner agitation blade plane can in particular be aligned so as to be at least substantially parallel with a rotation axis of the agitation shaft. The rotation axis is advantageously situated in the inner agitation blade plane. "At least substantially" in this context is in particular to be understood in the sense that a deviation from a predefined value deviates in particular by less than 25%, preferably less than 10%, and particularly preferably less than 5% of the predefined value. A difference between an average width of the inner agitation blade and an average height of the inner agitation blade in percentage terms is preferably less than 50%. The inner agitation blade is preferably implemented so as to be separate from the outer agitation blade. The inner agitation blade and/or the outer agitation blade are/is in particular cut or punched from the plate-type workpiece and in particular subsequently machined in that said inner agitation blade and/or outer agitation blade are/is ground, for example, and the edges thereof are rounded. A reduction in terms of costs and/or time in the production process can be achieved on account thereof. The agitator device preferably has an inner agitation blade hub which is preferably integrally connected to the inner agitation blade. "Integrally" is in particular to be understood to be connected at least in a materially integral manner, for example by way of a welding process, an adhesive-bonding process, an injection-moulding process, and/or any other process that is considered expedient by a person skilled in the art, and/or advantageously to be moulded in one piece such as, for example, by way of being produced from one casting, and/or by way of being produced in a single or multi component injection-moulding method, and advantageously from a single blank. The outer agitation blade hub can be capable of being fastened to the agitation shaft in particular by means of a materially integral connection, preferably by means of a form-fitting and/or force-fitting connection. The outer agitation blade hub and/or the inner agitation blade hub are/is in particular implemented at least to a large part, and in particular completely, from a metal, for example from steel and/or stainless steel, and/or any other arbitrary metal such as, for example, aluminium and/or titanium and/or an alloy. However, it is also conceivable for the outer agitation blade hub and/or the inner agitation blade hub to be at least in part made from a plastics material. A reliable and/or in particular a robust construction can advantageously be achieved on account thereof.

In particular, a normal of the inner agitation blade plane in the assembled state is aligned so as to be perpendicular to the rotation axis of the agitator device such that the inner agitation blade preferably causes a radial flow component. The inner agitation blade preferably has a trapezoidal inner agitation blade outer contour, wherein a lower side of the inner agitation blade is wider than an upper side, at least when viewed perpendicularly to the agitation shaft. The lower side and the upper side are preferably aligned so as to be mutually parallel and perpendicular to the agitation shaft. The inner agitation blade outer contour has in particular at least one right inner agitation blade angle and at least one acute inner agitation blade angle. The inner agitation blade is preferably implemented in an integral manner. "Integral" is in particular to be understood as moulded in one piece. This one piece is preferably produced from a single blank, a compound and/or a casting, particularly preferably in an injection-moulding method, in particular a single and/or multicomponent injection-moulding method. It is also conceivable for the inner agitation blade to have a split embodiment, wherein the inner agitation blade is split into a plurality of segments which are in each case capable of being fastened to the agitation shaft by means of a segment hub such that the segments assembled in at least one assembled state configure the inner agitation blade. A cost-effective production and/or simple servicing can in particular be enabled on account thereof. Furthermore, a simple and flexible assembly can be implemented on account thereof. Moreover, an advantageous radial flow component can in particular be generated.

In one advantageous design embodiment of the invention it is proposed that the outer agitation blade is situated at least to a large part, in particular completely, in an outer agitation blade plane. The outer agitation blade preferably has an integral embodiment. The outer agitation blade can in particular also have a split embodiment, on account of which an assembly of lower complexity can be achieved. The outer agitation blade plane is in particular aligned so as to be angled in relation to the agitation shaft, on account of which a minimum pitch angle between the outer agitation blade plane and a straight line that emanates perpendicularly from the agitation shaft is preferably created, wherein the pitch angle is particularly preferably at least substantially equal to at least one acute inner agitation blade angle. The pitch angle is in particular more than 0° and less than 90°. The pitch angle is preferably 50° and 70°. The pitch angle is particularly preferably 60°. The outer agitation blade plane and the inner agitation blade plane include in particular a right angle. In particular, the outer agitation blade and the inner agitation blade in a full revolution about the agitation axis in at least one operational state when viewed along the agitation shaft describe in each case a largest circle, wherein the circles are concentric and have in particular radii of dissimilar sizes. The agitator device preferably has at least one outer agitation blade hub, wherein the outer agitation blade hub is capable of being fastened to the agitation shaft by means of a materially integral connection, preferably by means of a form-fitting and/or force-fitting connection. On account thereof, a cost-effective production that is flexible in terms of method technology, and/or simple servicing of the outer agitation blade can be enabled.

The agitator device, in particular the inner agitation blade and/or the outer agitation blade, is/are preferably at least to a large part, and in particular completely, implemented from a metal, for example from steel and/or stainless steel, and or any arbitrary other metal such as, for example aluminium and/or titanium and/or an alloy. However, it is also conceivable for the agitator device to be at least in part made from a plastics material. It is furthermore conceivable for individual components of the agitator device to be composed of dissimilar materials.

It is furthermore proposed that the vane-type conveying unit has at least one passage gap. The passage gap is in particular arranged between the outer agitation blade and the inner agitation blade and is at least in part delimited by the latter two such that the passage gap preferably has two mutually opposite, parallel delimitations. The passage gap is in particular configured for excluding part of a medium to be mixed from being conveyed in a radial direction and in particular for generating a turbulent flow component. On account thereof, advantageous mixing properties can be achieved. Moreover, a starting torque of the agitator device can be reduced on account thereof.

It is moreover proposed that at least one extent of the passage gap is capable of being set, wherein an "extent" is in particular to be understood to be a smallest spacing between the outer agitation blade and the inner agitation blade along the passage gap. The positioning of the inner agitation blade on the agitation shaft as well as of the outer agitation blade is in particular capable of being set in a mutually variable manner, on account of which the extent of the passage gap is variable. The extent of the passage gap is in particular capable of being set by a displacement of the inner agitation blade relative to the outer agitation blade along the agitation shaft, and/or by a rotation of the inner agitation blade relative to the outer agitation blade about the agitation axis. A minimum, in particular a minute, extent of the passage gap in the case of a position of the outer agitation blade and of the inner agitation blade at which position the outer agitation blade plane and the inner agitation blade plane intersect at a right angle is implementable by displacing the inner agitation blade relative to the outer agitation blade along the agitation shaft. By displacing the inner agitation blade relative to the outer agitation blade along the agitation shaft, a minimum extent of the passage gap is in particular adaptable between a minimum, in particular a minute, extent and a maximum extent which is established by a respective construction of the outer agitation blade and of the inner agitation blade.

A geometry of the shovel-type conveying unit is thus in particular variable and adaptable to dissimilar qualities and properties of the medium, for example a density, viscosity, a physical state of a dispersed phase and/or of a dispersion medium. Advantageous agitating, mixing and/or dispersing properties can be achieved on account thereof. A setting capability of a ratio of a flow that is parallel with the agitation shaft in relation to a flow that is perpendicular to the agitation shaft can be particularly advantageously achieved on account thereof.

It is moreover proposed that the inner agitation blade has at least one inner agitation blade normal, and the outer agitation blade has at least one outer agitation blade normal, wherein the inner agitation blade normal and the outer agitation blade normal include a minimum normal angle of more than 00 and at most 90°. The inner agitation blade normal corresponds in particular to at least one normal vector of the inner agitation blade plane, and the outer agitation blade normal corresponds to at least one further normal vector of the outer agitation blade plane. The pitch angle that is included by the outer agitation blade plane and by the straight line that emanates perpendicularly from the agitation axis is in particular linked to the normal angle by a correlation: normal angle=(90°−pitch angle). A design of the conveying unit that is advantageous in terms of flow technology can in particular be implemented on account thereof.

In order to be advantageously able to implement a high variability in an adaptation of a shape of the conveying unit it is proposed that the minimum normal angle is capable of being set. Setting the normal angle can be carried out by a rotation of the inner agitation blade and/or of the outer agitation blade about the agitation shaft on which the inner agitation blade and the outer agitation blade are arranged by means of the inner agitation blade hub and/or the outer agitation blade hub.

It is moreover proposed that the inner agitation blade is capable of being fastened to the agitation shaft in various angle positions in relation to the outer agitation blade. The inner agitation blade by way of the inner agitation blade hub is in particular fastened to the agitation shaft by means of a connection that is releasable in a non-destructive manner, for example by means of a screw connection, pin connection, bolt connection, and/or by means of a shaft-to-hub connection, or any other form-fitting and/or force-fitting connection known to a person skilled in the art. The normal angle can advantageously be flexibly adapted on account thereof.

It is furthermore proposed that the agitator device comprises at least one bar by way of which the outer agitation blade is connected to the agitation shaft. The bar preferably connects the outer agitation blade to the outer agitation blade hub, wherein the outer agitation blade hub and thus the outer agitation blade is capable of being fastened to the agitation shaft. The direction of main extent of the bar advantageously runs along a straight line that is perpendicular to the agitation shaft. However, an angular profile of the direction of main extent of the bar is also conceivable. A "direction of main extent" of an object herein is in particular to be understood to be a direction which runs parallel with a longest edge of a smallest geometric cuboid which only just completely encloses the object. The bar preferably has a circular cross section, wherein other cross-sectional shapes are also conceivable. The agitator device preferably has two bars which at different locations, preferably on an upper outer agitation blade side that faces the agitation shaft, and on a lower outer agitation blade side that faces the agitation shaft, connect the outer agitation blade, in particular by way of the outer agitation blade hub, to the agitation shaft. In particular, the outer agitation blade hub and the bar, as well as the outer agitation blade and the bar, are mutually connected in an integral manner. It is also conceivable that a number of bars that differs from two connects the outer agitation blade to the agitation shaft. In particular, the bar is at least to a large part, and in particular completely, implemented from a metal, for example from steel and/or stainless steel, and/or any arbitrary other metal such as, for example, aluminium and/or titanium and/or an alloy. However, it is also conceivable for the bar at least in part to be made from a plastics material. A stable connection of the outer agitation blade to the agitation shaft can advantageously be established on account thereof.

Particularly complete and effective mixing can be achieved when the agitator device has at least one bottom agitation blade which, when viewed along the agitation shaft, is arranged below the outer agitation blade and/or the inner agitation blade. The agitator device has in particular a bottom agitation blade hub which is preferably connected to the bottom agitation blade by means of a materially integral connection, preferably by means of a weld seam. The bottom agitation blade is in particular implemented so as to be plate-type and is situated at least to a large part within a bottom agitation blade plane. The agitation axis preferably is situated within the bottom agitation blade plane. In particular, a bottom agitation blade normal which is parallel with a normal vector of the bottom agitation blade, and the inner agitation blade normal lie in two parallel planes. In particular, the bottom agitation blade, when viewed perpendicularly to the agitation axis, has at least section-wise a convex contour. The bottom agitation blade and/or the bottom agitation blade hub are/is preferably at least to a large part, and in particular completely, implemented from a metal, for example from steel and/or stainless steel, and or any arbitrary other metal such as, for example, aluminium and/or titanium and/or an alloy. The outer agitation blade, the inner agitation blade, and the bottom agitation blade are preferably implemented so as to be mutually separate. However, it is also imaginable for the outer agitation blade, the inner agitation blade, and/or the bottom agitation blade to be implemented in an integral manner.

In one advantageous design embodiment of the invention it is proposed that the bottom agitation blade is capable of being fastened to the agitation shaft in various angle positions in relation to the outer agitation blade and in particular in relation to the inner agitation blade.

In particular, the bottom agitation blade normal and the outer agitation blade normal have a first minimum angle position which is more than 00 and at most 90°. The pitch angle is in particular linked to the first angle position by a correlation: first angle position=(90°−pitch angle). The bottom agitation blade in particular has a second minimum angle position which is included by the bottom agitation blade normal and the inner agitation blade normal, wherein the second minimum angle position lies between 0° and 180°. Mixing of the medium that is particularly advantageous in terms of flow technology can in particular be implemented on account thereof.

In one preferred design embodiment of the invention it is proposed that the agitator device has at least one further outer agitation blade which is implemented in a manner analogous to the outer agitation blade. The agitator device preferably has two outer agitation blades which in relation to the agitation shaft are mutually opposite in a mirror-symmetrical manner and are connected to the outer agitation blade hub by means of a respective bar. In particular, each point of the one outer agitation blade in each agitation plane, which is situated perpendicularly to the agitation axis, by a rotation of 180° about the agitation axis can be superimposed by a corresponding point of the further outer agitation blade. In particular when N is a number of outer agitation blades, a mutual angular distance of the individual outer agitation blades in each agitation plane is 360°/N. The agitator device preferably has one further inner agitation blade and/or one further bottom agitation blade. The agitator device preferably has in each case two inner agitation blades which are connected to the inner agitation blade hub in particular by means of a materially integral connection, and two bottom agitation blades which are connected to the bottom agitation blade hub by means of a materially integral connection. The number of outer agitation blades, of inner agitation blades, and/or of bottom agitation blades can in particular vary and in each case be more than two pieces. An efficient and requirement-oriented design embodiment of the agitator device can be achieved on account thereof.

It is moreover proposed that the outer agitation blade and the further outer agitation blade, at least when viewed perpendicularly to the agitation shaft, in particular along a direction that is parallel with the bar, conjointly form a closed curved outer contour, in particular an ellipse. In said view, the outer agitation blade and the further outer agitation blade mutually overlap in particular at least in part in a lower and in an upper region of the outer contour in which regions a connection between the respective bar and the respective outer agitation blade is established. The outer contour is preferably mirror-symmetrical in relation to the agitation shaft. It is imaginable for the outer contour to have an, in particular non-closed, geometric shape which deviates from that of the ellipse. Advantageous agitating properties in terms of flow technology can be achieved on account thereof.

It is moreover proposed that the outer agitation blade and the further outer agitation blade, at least when viewed perpendicularly to the agitation shaft, conjointly form an ellipse having a non-elliptic recess. The recess preferably has at least in part an elliptic inner contour which is delimited by the arm-shaped sections of the outer agitation blade and of the further outer agitation blade. In particular, a lower region of the surface enclosed by the outer contour is closed, in particular to the extent of approximately one third. Optimized mixing properties can in particular be achieved on account thereof.

Furthermore, an agitator having at least one agitator device is proposed. The agitator device particularly has a diameter of at least 0.2 metres, preferably of at least 0.5 metres, particularly preferably of at least 1 metre.

Furthermore, an agitation system having at least one container and having at least one agitator arranged in the container is proposed. The agitation system is in particular provided for industrial applications, in particular for polymerization processes, preferably in a polymerization reactor. The container has in particular a volume of at least 10 litres, preferably of at least 100 litres, particularly preferably of at least 500 litres.

The agitator device according to the invention herein is not to be limited to the application and embodiment described above. In particular, the agitator device according to the invention in order to meet a functional mode described herein can have a number of individual elements, components, and units that deviate from a number mentioned herein.

DRAWINGS

Further advantages are derived from the following description of the drawings. An exemplary embodiment of the invention is illustrated in the drawings. The drawings, the description, and the claims contain numerous features in combination. A person skilled in the art will expediently also consider the features individually and combine said features so as to form meaningful further combinations.

DESCRIPTION OF THE EXEMPLARY EMBODIMENT

Figure 1:
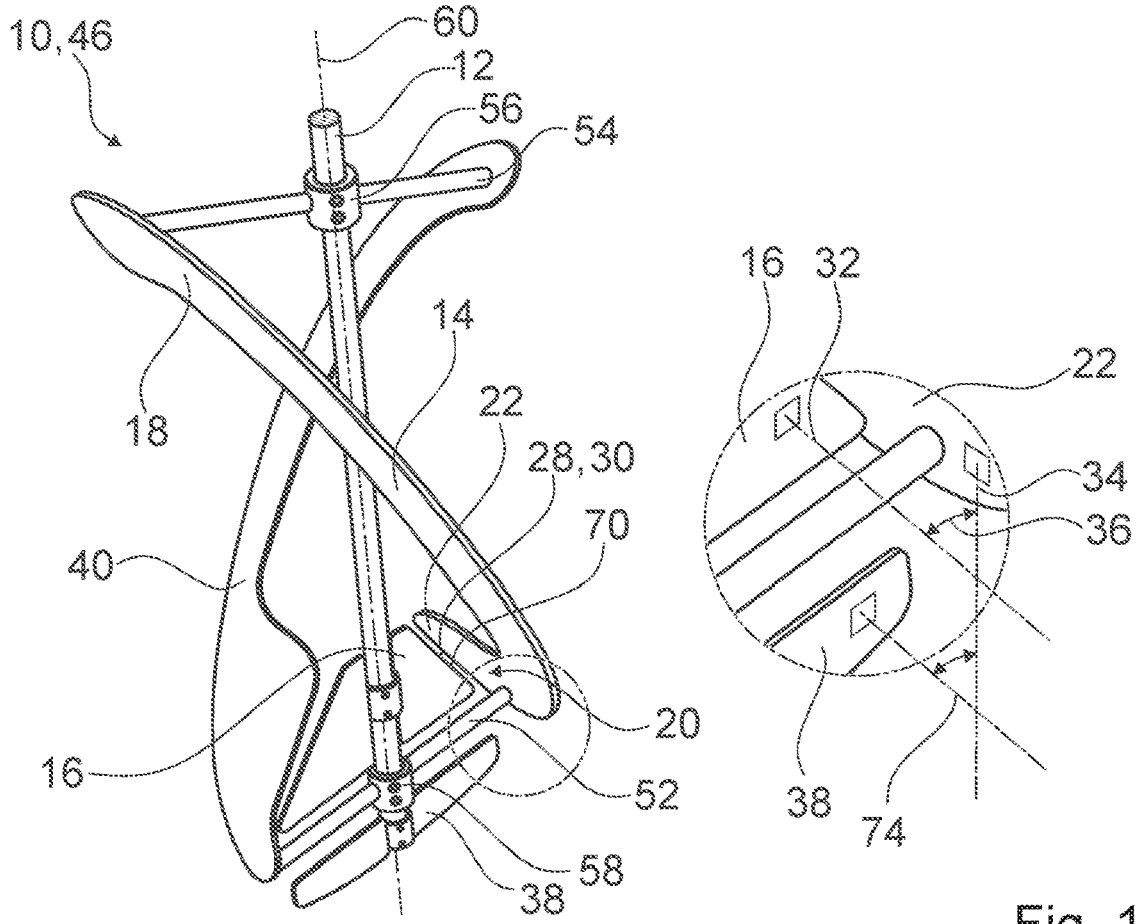
FIG. 1 shows part of an agitator having an agitator device in a perspective side view.

Various functional units and/or components are present in multiples in the exemplary embodiment described hereunder. For the sake of simplicity, analogously designed components and/or functional units which are provided with the same reference signs in the drawings are described only once in the description of the drawings hereunder.

FIG. 1 shows part of an agitator 46 having at least one agitator device 10 in a perspective side view. The agitator device 10 is embodied as a non-close-clearance agitator device 10, in particular with respect to a vessel wall. The agitator device 10 is in particular configured for mixing low-viscosity to medium-viscosity media. The agitator device 10 has an agitation shaft 12. The agitation shaft 12 in at least one operational state rotates about an agitation axis 60 of the agitation device 10. The agitation shaft 12 transmits a torque and sets elements arranged on the agitation shaft 12 in a rotating motion. An outer agitation blade 14 and a further outer agitation blade 40 of the agitator device 10 are arranged on the agitation shaft 12. The further outer agitation blade 40 is implemented in a manner analogous to that of the outer agitation blade 14.

An inner agitation blade 16 and a further inner agitation blade 48 of the agitator device 10 are arranged on the agitation shaft 12. The further inner agitation blade 48 is implemented in a manner analogous to that of the inner agitation blade 16.

A bottom agitation blade 38 and a further bottom agitation blade 50 of the agitator device are arranged on the agitation shaft 12. The further bottom agitation blade 50 is implemented in a manner analogous to that of the bottom agitation blade 38.

The outer agitation blade 14, the inner agitation blade 16, and the bottom agitation blade 38 are in each case described hereunder, wherein the description is in each case to apply also to the further outer agitation blade 40, the further inner agitation blade 48, and the further bottom agitation blade 50.

The outer agitation blade 14 has a section 18 implemented so as to be arm-shaped. The outer agitation blade 14 has a further section 22. The further section 22 is adjacent to the section 18. The outer agitation blade 14 is implemented so as to be wider in the further section 22 than in the section 18.

Figure 2:
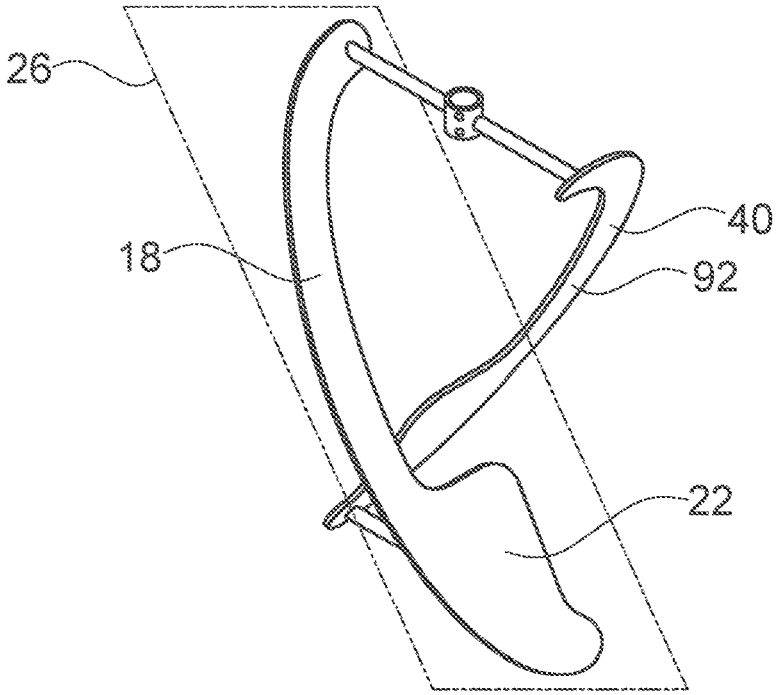
FIG. 2 shows an outer agitation blade of the agitator device and a further outer agitation blade of the agitator device, in each case connected to the outer agitation blade hubs of the agitator device by means of bars of the agitator device, in a perspective side view.

The agitator device 10 has a first outer agitation blade hub 56. The agitator device 10 has a further outer agitation blade hub 58. The agitator device 10 has a first bar 52. The agitator device 10 has a second bar 54. The outer agitation blade 14 in the section 18 is connected to the first outer agitation blade hub 56 by means of the first bar 52 of the agitator device 10 (FIG. 2). The outer agitation blade 14 in the further section 22 is connected to the further outer agitation blade hub 58 by means of the second bar 54. The first outer agitation blade hub 56 and the further outer agitation blade hub 58 are in each case fastened to the agitation shaft 12 by means of a screw connection. Further connections of the first outer agitation blade hub 56 and of the second outer agitation blade hub 58, for example a clamping connection, are also imaginable. Proceeding from the agitation shaft 12, the first bar 52 and the second bar 54, when viewed along the agitation shaft 12, point in opposite directions, such that the first bar 52 and the second bar 54 include an angle of 180°. The first bar 52 and the second bar 54 are in each case aligned perpendicularly to the agitation shaft 12.

The agitator device 10 has an outer agitation blade plane 26. The outer agitation blade 14 is situated completely in the outer agitation blade plane 26 (FIG. 2). The section 18 that is implemented so as to be arm-shaped has a consistent smallest section thickness 104 that is situated in the outer agitation blade plane 26. The section thickness 104 is preferably between 5% of a diameter 102 of the agitator device 10 and less than 50% of the diameter 102, particularly preferably is 15% of the diameter 102. The outer agitation blade 14 and the further outer agitation blade 40, when viewed perpendicularly to the agitation shaft 12 and to a direction of main extent of the bar 52, form an X-shaped contour. A "direction of main extent" of an object is in particular to be understood to be a direction which runs parallel with a longest edge of a smallest geometric cuboid which only just completely encloses the object.

The inner agitation blade 16 has at least one inner agitation blade normal 32 (FIG. 1). The outer agitation blade 14 has at least one outer agitation blade normal 34. The inner agitation blade normal 32 and the outer agitation blade normal 34 include a minimum normal angle 36 of 90°. The normal angle 36 can be more than 0° and at most 90°.

The normal angle 36 is capable of being set. An adaptation of the normal angle 36 can be performed, for example, by means of a rotation of the inner agitation blade 16 about the agitation axis 60. The normal angle 36 depends on an inclination of the outer agitation blade 14 in relation to a plane perpendicular to the agitation axis 60.

Figure 3:
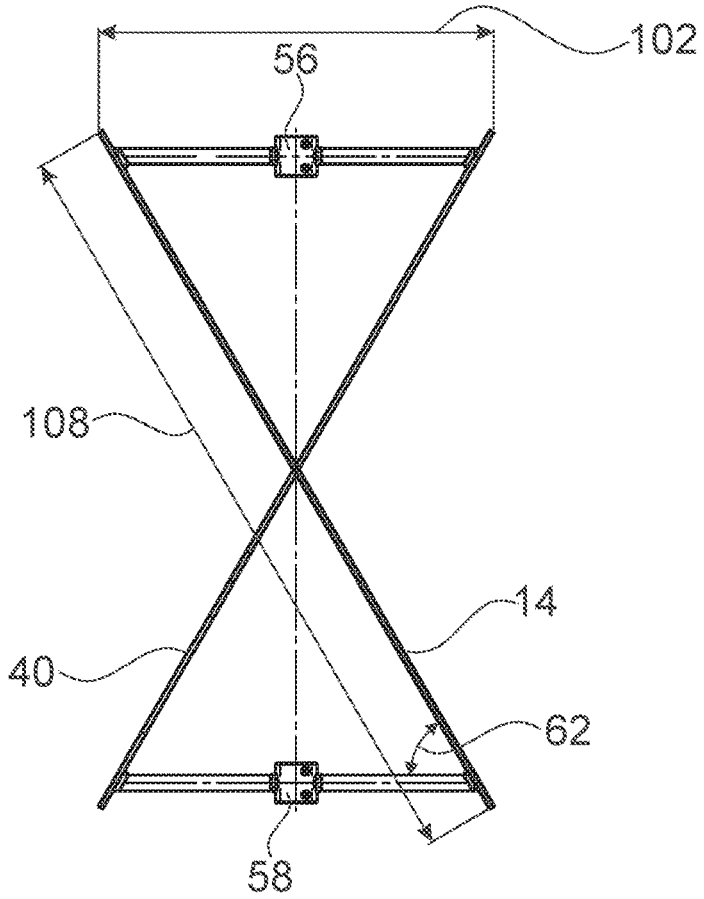
FIG. 3 shows the outer agitation blade and the further outer agitation blade in a side view transversely to a bar-to-hub connection of the agitator device.
Figure 5:
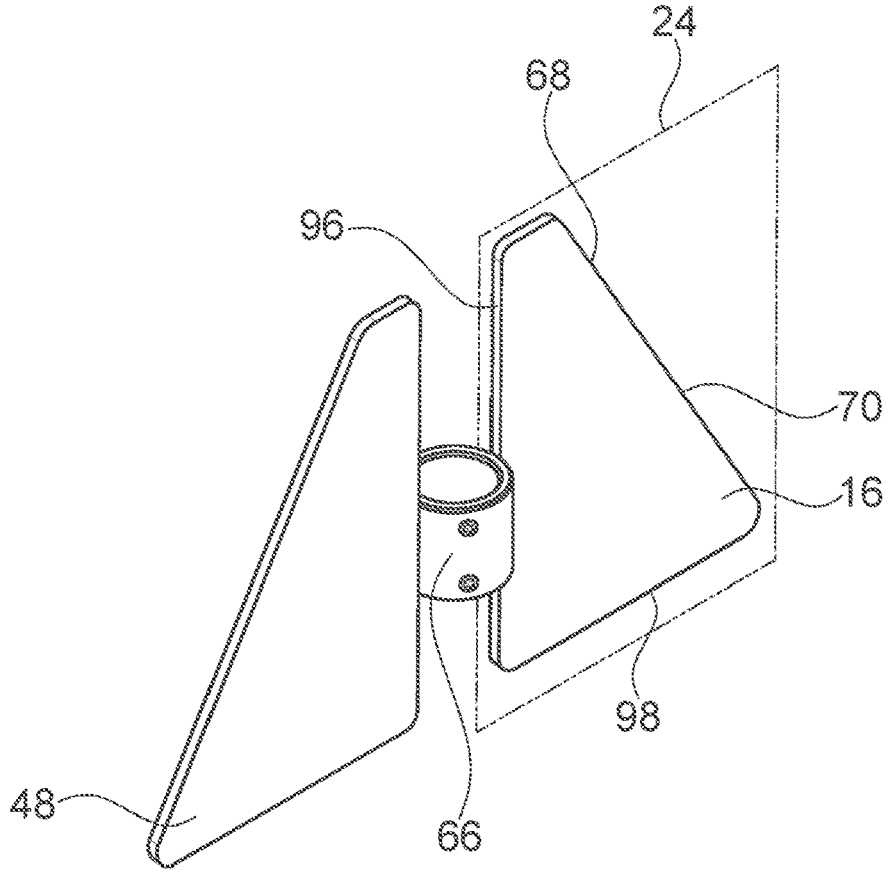
FIG. 5 shows an inner agitation blade of the agitator device and a further inner agitation blade of the agitator device fastened to an inner agitation blade hub of the agitator device, in a perspective side view.

The outer agitation blade 14 has an outer agitation blade length 108 (FIG. 3). The outer agitation blade 14 has a pitch angle 62 in relation to a plane aligned perpendicularly to the agitation shaft 12. The pitch angle 62 is preferably 60°. The normal angle 36 can be determined from the correlation normal angle 36=(90°−pitch angle 62). The agitator device 10 has a diameter 102 (FIG. 3). The diameter 102 is linked to the pitch angle 62 by a correlation cos(pitch angle 62)=diameter 102/outer agitation blade length 108. FIG. 5 shows the inner agitation blade 16. The agitator device 10 has an inner agitation blade plane 24. The inner agitation blade 16 is situated completely in the inner agitation blade plane 24. The inner agitation blade 16 is implemented so as to be plate-type. The agitator device 10 has an inner agitation blade hub 66. The inner agitation blade 16 and the further inner agitation blade 48 are arranged on the inner agitation blade hub 66. The inner agitation blade 16 and the further inner agitation blade 48 are in each case arranged on the inner agitation blade hub 66 by means of a welded connection. The inner agitation blade hub 66 is fastened to the agitation shaft 12 by means of a screw connection. Further connections of the inner agitation blade hub 66, for example a clamping connection, are also imaginable. An angular distance between the inner agitation blade 16 and the further inner agitation blade 48 is 180°. In the case of a plurality of inner agitation blades, the individual inner agitation blades are arranged at an equidistant angular distance. The angular distance can be determined according to the correlation 360°/number of inner agitation blades.

The inner agitation blade 16, when viewed along the inner agitation blade normal 32, has a trapezoidal contour 68. The trapezoidal contour 68 has sides 96, 98 which are arranged so as to be mutually perpendicular, wherein one of the sides 96 runs parallel with the agitation shaft 12 and the other side 98 runs perpendicularly to the agitation shaft 12. The trapezoidal contour 68 has a further side 70 which runs parallel with the outer agitation blade plane 26.

The inner agitation blade 16 conjointly with the further section 22 of the outer agitation blade 14 implements a vane-type conveying unit 20 of the agitator device 10. The conveying unit 20 is configured for conveying a medium in a direction parallel with the agitation shaft 12 and in a further direction perpendicular to the agitation shaft 12. On account thereof, a radial flow of the medium, wherein the radial flow is in particular directed perpendicularly to the agitation shaft 12, and an axial flow of the medium, wherein the axial flow is in particular directed parallel with the agitation shaft 12, can be created.

The vane-type conveying unit 20 has a passage gap 28 (FIG. 1). The passage gap 28 is delimited by the 15 further side 70 of the trapezoidal contour 68 of the inner agitation blade 16 and by the outer agitation blade plane 26.

An extent 30 of the passage gap 28 is capable of being set. For example, the inner agitation blade 16 is displaceable along the agitation shaft 12. Moreover, the inner agitation blade 16 can be rotatable about the agitation shaft 12. The inner agitation blade 16 is capable of being fastened to the agitation shaft 12 at various angle positions in relation to the outer agitation blade 14.

The passage gap 28 can either be completely closed or be open to the maximum. The passage gap 28 is of maximum size in the case of the inner agitation blade 16 being set perpendicularly to the direction of main extent of the bar 52.

The bottom agitation blade 38, when viewed along the agitation shaft 12, is arranged below the outer agitation blade 14 and/or the inner agitation blade 16 (FIG. 1).

Figure 6:
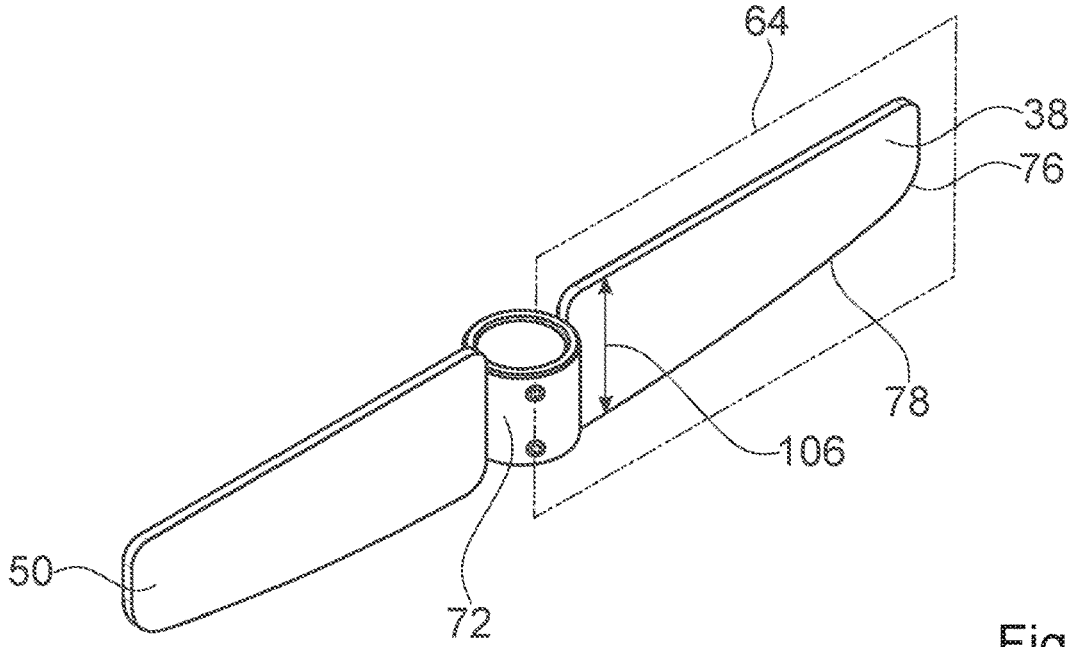
FIG. 6 shows a bottom agitation blade of the agitator device and a further bottom agitation blade of the agitator device fastened to a bottom agitation blade hub of the agitator device, in a perspective side view.

The agitator device 10 has a bottom agitation blade plane 64. The bottom agitation blade 38 is situated completely in the bottom agitation blade plane 64 (FIG. 6). The bottom agitation blade 38 is implemented so as to be plate-type. The bottom agitation blade 38, when viewed in a direction parallel with a bottom agitation blade normal 74 of the bottom agitation blade 38, has a largest expanse 106 parallel with the agitation shaft 12, said expanse 106 being between 5% of the diameter 102 and less than 50% of the diameter 102, particularly preferably 15% of the diameter 102. The agitator device 10 has a bottom agitation blade hub 72. The bottom agitation blade 38 and the further bottom agitation blade 50 are arranged on the bottom agitation blade hub 72. The bottom agitation blade 38 and the further bottom agitation blade 50 are in each case arranged on the bottom agitation blade hub 72 by means of a welded connection. The bottom agitation blade hub 72 is fastened to the agitation shaft 12 by means of a screw connection. Further connections of the bottom agitation blade hub 72, for example a clamping connection, are also imaginable. An angular distance between the bottom agitation blade 38 and the further bottom agitation blade 50 is 180°. In the case of a plurality of bottom agitation blades, the individual bottom agitation blades are arranged at an equidistant angular distance. The angular distance can be determined according to the correlation 360°/number of bottom agitation blades.

The bottom agitation blade 38, when viewed along the bottom agitation blade normal 74, has a contour 76 which comprises a convex side 78. The agitator 46 is disposable in a container 80. The convex side 78 is adapted to a bottom 82 of the container 80.

The bottom agitation blade 38 is capable of being fastened to the agitation shaft 12 at various angle positions in relation to the outer agitation blade 14. The bottom agitation blade 38 is capable of being fastened at various angle positions in relation to the inner agitation blade 16. The angle positions can be set by means of a rotation of the bottom agitation blade hub 72 about the agitation shaft 12.

The conveying unit 20 and all further conveying units which are formed by further sections and further inner agitation blades, in a rotating movement of the agitator device 10 about the agitation axis 60 in at least one operational state at all times point in an identical rotational direction.

Figure 4:
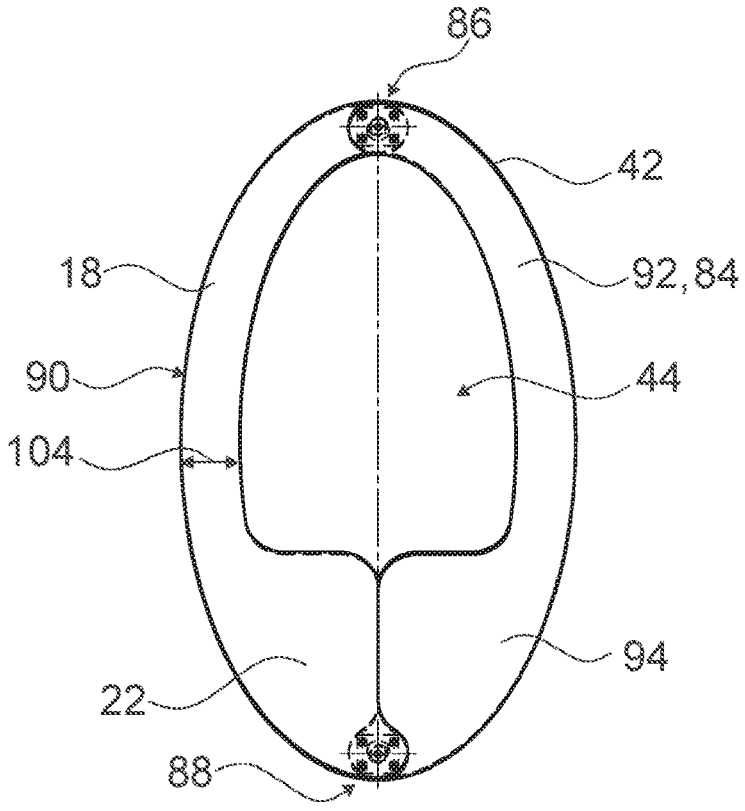
FIG. 4 shows the outer agitation blade and the further outer agitation blade in a side view along the bar-to-hub connection.

FIG. 4 shows the outer agitation blade 14 and the further outer agitation blade 40 when viewed perpendicularly to the agitation shaft 12. The outer agitation blade 14 and the further outer agitation blade 40 conjointly form a closed curved outer contour 42. The curved outer contour 42 is implemented as an ellipse 84. The outer agitation blade 14 and the further outer agitation blade 40, when viewed perpendicularly to the agitation shaft 12, mutually overlap in an upper and a lower apex region 86, 88 of the ellipse 84. Connection locations of the bars 52, 54 to the outer agitation blade 14 and to the further outer agitation blade 40 are located in regions in which the outer agitation blade 14 and the further outer agitation blade 40 mutually overlap when viewed perpendicularly to the agitation shaft 12. A lower third of the surface 90 enclosed by an ellipse 84 is closed.

The outer agitation blade 14 and the further outer agitation blade 40, when viewed perpendicularly to the agitation shaft 12, conjointly form the ellipse 84 having a non-elliptic recess 44. The recess 44 in upper and lateral regions is delimited by respective arm-shaped sections 18, 92 of the outer agitation blade 14 and of the further outer agitation blade 40. The recess 44 in a lower region of the recess 44 is delimited by respective further sections 22, 94 of the outer agitation blade 14 and of the further outer agitation blade 40.

Figure 7:
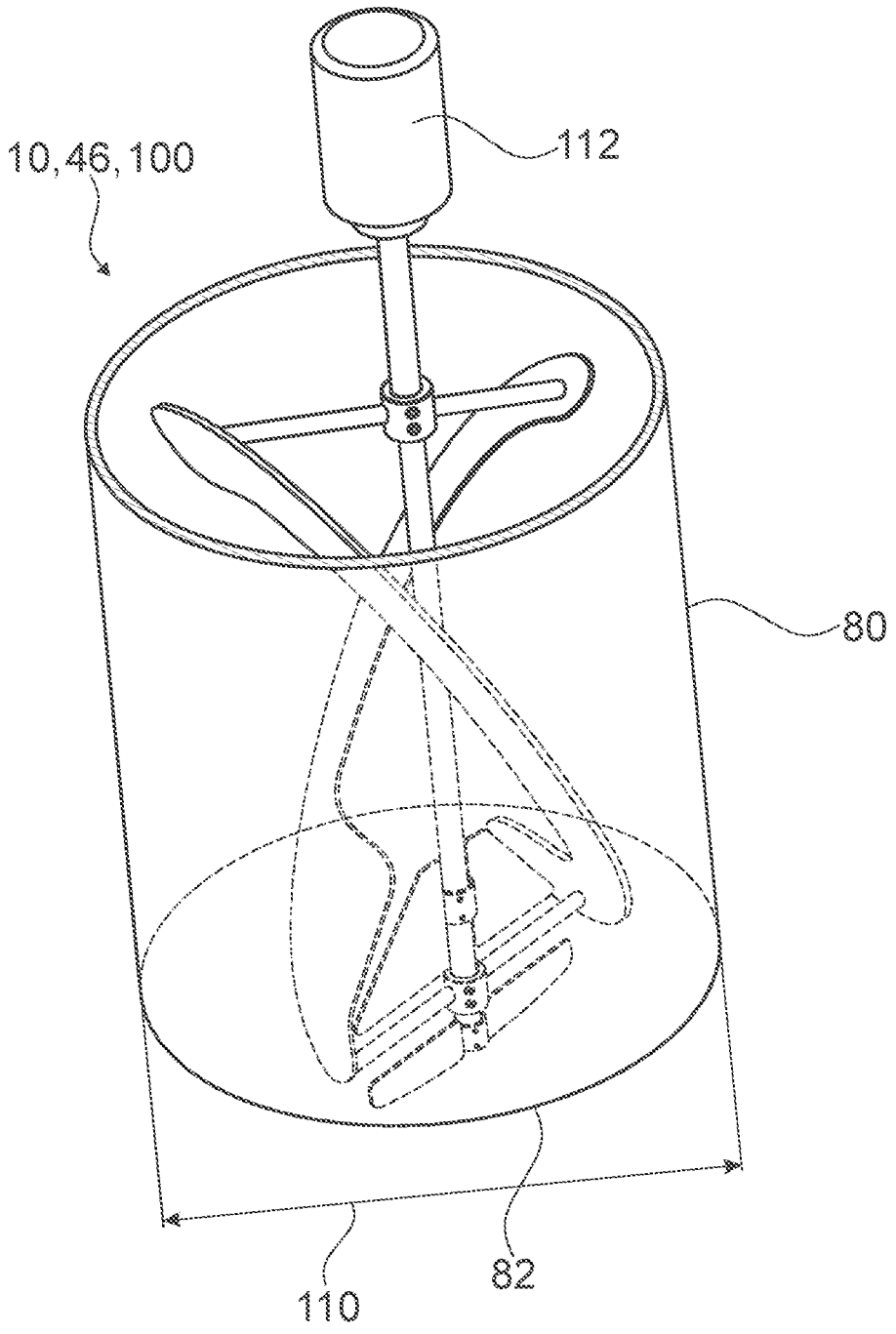
FIG. 7 shows an agitation system having the agitator arranged in a container.

FIG. 7 shows an agitation system 100 having the agitator 46 arranged in the container 80. The container 80 is configured for receiving a medium to be processed by the agitator 46. The container 80 has a container diameter 110. The container diameter 110 is in particular larger than the diameter 102 of the agitator device 10 by a factor of at least 1.05. The agitator 46 has at least one motor 112. The motor 112 is in particular connected to the agitation shaft 12. The motor 112 is configured for transmitting a torque to the agitator 46 in at least one operational state. The agitator 46 in at least one operational state generates a first flow which is directed perpendicularly to the agitation shaft 12, and a second flow which is directed at least substantially parallel with the agitation shaft 12. The first flow is established substantially by the inner agitation blade 16. The second flow is established substantially by the outer agitation blade 14. The proportion of the first flow in an overall flow is determined by the extent 30 of the passage gap 28.

REFERENCE SIGNS

10 Agitator device
12 Agitation shaft
14 Outer agitation blade
16 Inner agitation blade
18 Section
20 Conveying unit

22 Section
24 Inner agitation blade plane
26 Outer agitation blade plane
28 Passage gap
30 Extent
32 Inner agitation blade normal
34 Outer agitation blade normal
36 Normal angle
38 Bottom agitation blade
40 Outer agitation blade
42 Outer contour
44 Recess
46 Agitator
48 Inner agitation blade
50 Bottom agitation blade
52 Bar
54 Bar
56 Outer agitation blade hub
58 Outer agitation blade hub
60 Agitation axis
62 Pitch angle
64 Bottom agitation blade plane
66 Inner agitation blade hub
68 Contour
70 Side
72 Bottom agitation blade hub
74 Bottom agitation blade normal
76 Contour
78 Convex side
80 Container
82 Bottom
84 Ellipse
86 Apex region
88 Apex region
90 Surface
92 Section
94 Section
96 Side
98 Side
100 Agitation system
102 Diameter
104 Section thickness
106 Expanse
108 Outer agitation blade length
110 Container diameter
112 Motor

The invention claimed is:

1. A non-close-clearance agitator device, with respect to a vessel wall, comprising:

at least one agitation shaft and having at least one outer agitation blade which is held on the agitation shaft and which in at least one section is implemented so as to be arm-shaped, at least one inner agitation blade which conjointly with the outer agitation blade implements at least one vane-type conveying unit which is at least configured for conveying a medium in at least one direction parallel with the agitation shaft and in at least one further direction perpendicular to the agitation shaft, at least one bar by way of which the outer agitation blade is connected to the agitation shaft, at least one further outer agitation blade which is implemented in a manner analogous to the outer agitation blade, wherein a normal of an inner agitation blade plane in the assembled state is aligned so as to be perpendicular to a rotation axis of the agitator device such that the inner agitation blade causes a radial flow component, and the vane-type conveying unit has at least one passage gap and wherein the outer agitation blade and the further outer agitation blade, when viewed perpendicularly to the agitation shaft and to a direction of main extent of the bar, form an X-shaped contour.

2. The agitator device according to claim 1, wherein the outer agitation blade has at least one further section which is adjacent to the section and in which the outer agitation blade is implemented so as to be wider than in the section.

3. The agitator device according to claim 1, wherein the inner agitation blade conjointly with the further section of the outer agitation blade implements the vane-type conveying unit.

4. The agitator device according to claim 1, wherein the inner agitation blade is situated at least to a large part in an inner agitation blade plane and is in particular implemented so as to be plate-type.

5. The agitator device according to claim 1, wherein the outer agitation blade is situated at least to a large part in an outer agitation blade plane.

6. The agitator device according to claim 1, wherein at least one of the at least one inner agitation blade and the at least one outer agitation blade is movable to one of a plurality of positions, and at least one extent of the passage gap is capable of being set based on a movement of the at least one of the at least one inner agitation blade and the at least one outer agitation blade to one of the plurality of positions.

7. The agitator device according to claim 1, wherein the inner agitation blade has at least one inner agitation blade normal, and the outer agitation blade has at least one outer agitation blade normal, wherein the inner agitation blade normal and the outer agitation blade normal include a minimum normal angle of more than 0° and at most 90°.

8. The agitator device according to claim 7, wherein the minimum normal angle is capable of being set.

9. The agitator device according to claim 1, wherein the inner agitation blade is capable of being fastened to the agitation shaft in various angle positions in relation to the outer agitation blade.

10. The agitator device according to claim 1, comprising at least one bottom agitation blade which, when viewed along the agitation shaft, is arranged below the outer agitation blade and/or the inner agitation blade.

11. The agitator device according to claim 10, wherein the bottom agitation blade is capable of being fastened to the agitation shaft in various angle positions in relation to the outer agitation blade.

12. The agitator device according to claim 1, wherein the outer agitation blade and the further outer agitation blade, at least when viewed perpendicularly to the agitation shaft, conjointly form a closed curved outer contour.

13. The agitator device according to claim 1, wherein the outer agitation blade and the further outer agitation blade, at least when viewed perpendicularly to the agitation shaft, conjointly form an ellipse having a non-elliptic recess.

14. An agitator with at least one agitator device according to claim 1.

15. An Agitation system having at least one container and having at least one agitator according to claim 14 arranged in the container.

16. The agitator device according to claim 1, wherein the inner agitation blade has a trapezoidal inner agitation blade outer contour, wherein a lower side of the inner agitation blade is wider than an upper side, at least when viewed perpendicularly to the agitation shaft.

17. The agitator device according to claim 1, wherein the passage gap is arranged between the outer agitation blade and the inner agitation blade and is at least in part delimited by the latter two such that the passage gap has two mutually opposite, parallel delimitations.

18. The agitator device according to claim 1, comprising at least one further bar by way of which the further outer agitation blade is connected to the agitation shaft, wherein, when viewed along the agitation shaft, the bar and the further bar point in opposite directions, such that the bar and the further bar include an angle of 180°.

19. A non-close-clearance agitator device with respect to a vessel wall comprising:

at least one agitation shaft, which in at least one operational state rotates about an agitation axis of the agitator device; and at least one outer agitation blade which is held on the agitation shaft and which in at least one section is implemented so as to be arm-shaped, a first outer agitation blade hub, a further outer agitation blade hub, a first bar and a second bar, wherein the outer agitation blade has an average width, which is a largest average expanse of the outer agitation blade perpendicular to the agitation axis, the outer agitation blade has at least one further section which is adjacent to the section and in which the outer agitation blade is implemented so as to be wider than in the section, the further section has an average width which exceeds an average width of the section by a factor of at least 2, the further section in relation to at least one operational position is arranged in a lower region of the agitator device, and the outer agitation blade in the section is connected to the first outer agitation blade hub by means of the first bar and the outer agitation blade in the further section is connected to the further outer agitation blade hub by means of the second bar.

* * * * *